US009206496B2

(12) United States Patent
Shikama et al.

(10) Patent No.: US 9,206,496 B2
(45) Date of Patent: Dec. 8, 2015

(54) ALUMINUM ALLOY EXTRUDED MATERIAL FOR ELECTRO-MAGNETIC FORMING

(71) Applicant: Kobe Steel, Ltd., Kobe-shi (JP)

(72) Inventors: Takahiro Shikama, Shimonoseki (JP); Shinji Yoshihara, Shimonoseki (JP)

(73) Assignee: KOBE STEEL, LTD., Kobe-shi (JP)

( * ) Notice: Subject to any disclaimer, the term of this patent is extended or adjusted under 35 U.S.C. 154(b) by 382 days.

(21) Appl. No.: 13/758,195

(22) Filed: Feb. 4, 2013

(65) Prior Publication Data

US 2013/0213533 A1 Aug. 22, 2013

(30) Foreign Application Priority Data

Feb. 16, 2012 (JP) ..... 2012-032204
Dec. 27, 2012 (JP) ..... 2012-286121

(51) Int. Cl.
*C22C 21/10* (2006.01)
*C22F 1/04* (2006.01)
*C22F 1/053* (2006.01)

(52) U.S. Cl.
CPC ..... *C22F 1/053* (2013.01); *C22C 21/10* (2013.01); *C22F 1/04* (2013.01); *Y10T 428/12292* (2015.01)

(58) Field of Classification Search
CPC ..... C22C 21/10; C22F 1/04; C22F 1/053; Y10T 428/12292
USPC ..... 148/417, 565; 420/532, 541; 428/586
See application file for complete search history.

(56) References Cited

U.S. PATENT DOCUMENTS

| | | | | |
|---|---|---|---|---|
| 6,302,973 | B1 * | 10/2001 | Haszler et al. | 420/541 |
| 8,613,820 | B2 * | 12/2013 | Smeyers et al. | 148/417 |
| 8,876,993 | B2 * | 11/2014 | Miyata et al. | 148/690 |
| 2004/0084119 | A1 * | 5/2004 | Sano et al. | 148/689 |
| 2005/0189044 | A1 * | 9/2005 | Benedictus et al. | 148/417 |
| 2005/0236075 | A1 * | 10/2005 | Gheorghe et al. | 148/417 |
| 2006/0284432 | A1 * | 12/2006 | Hashimoto et al. | 293/154 |
| 2009/0243314 | A1 * | 10/2009 | Hashimoto et al. | 293/149 |
| 2010/0289300 | A1 * | 11/2010 | Kokubo | 296/205 |
| 2013/0146183 | A1 * | 6/2013 | Miyata et al. | 148/417 |
| 2014/0102601 | A1 * | 4/2014 | Yoshida | 420/532 |

FOREIGN PATENT DOCUMENTS

| | | | |
|---|---|---|---|
| JP | 10-30147 | A | 2/1998 |
| JP | 2005-105327 | | 4/2005 |
| JP | 2007-119853 | | 5/2007 |
| JP | 2007-254833 | | 10/2007 |
| JP | 2009-114514 | | 5/2009 |
| JP | 2010-69927 | | 4/2010 |
| JP | 2010-159005 | | 7/2010 |
| JP | 2010-196089 | | 9/2010 |
| WO | WO 2010/142579 | A1 | 12/2010 |
| WO | WO 2012/165086 | A1 * | 12/2012 |

* cited by examiner

*Primary Examiner* — Helene Klemanski
(74) *Attorney, Agent, or Firm* — Oblon, McClelland, Maier & Neustadt, L.L.P.

(57) ABSTRACT

A 7000-series aluminum alloy hollow extruded material formed by porthole extrusion contains Zn: 3.0 to 8.0 mass %, Mg: 0.4 to 2.0 mass %, Cu: 0.05 to 2.0 mass %, Si: 0.3 mass % or less, Fe: 0.35 mass % or less, and one or more of Mn, Cr, and Zr: 0.10 mass % or less in total, with the balance being Al and unavoidable impurities. The aluminum alloy hollow extruded material has a recrystallized structure throughout the cross-section. In the case of pipe expansion by electro-magnetic forming, excellent pipe expansion formability is obtained.

13 Claims, 3 Drawing Sheets

A1

UNIT : μm

B8

UNIT : μm

A1

B8

ALUMINUM ALLOY EXTRUDED MATERIAL FOR ELECTRO-MAGNETIC FORMING

BACKGROUND OF THE INVENTION

I. Technical Field

The present invention relates to an aluminum alloy hollow extruded material for electro-magnetic forming with excellent pipe expansion properties in electro-magnetic forming.

II. Description of the Related Art

Electro-magnetic forming is a method in which a large current of 10 kA or more, for example, is instantaneously passed through a coil to create a strong magnetic field. Forming of a workpiece (conductor) to be shaped placed in the strong magnetic field is achieved by means of an interaction between an eddy current produced in the workpiece and the magnetic field. For example an aluminum alloy hollow extruded material (pipe) is subject to the electro-magnetic forming with an electro-magnetic forming coil placed therein, resulting in that the aluminum alloy hollow extruded material undergoes outward pipe expansion.

Because having low durability, a previous coil for electro-magnetic forming itself breaks when a high electro-magnetic force is produced. This limits the electro-magnetic force that can be output by the coil. Therefore, as raw materials for aluminum alloy hollow extruded material for electro-magnetic forming, aluminum alloys having moderate strength, such as 6000-series alloys, have been used. For example, JP-A-2010-159005 and JP-A-2010-69927 disclose the pipe expansion of a T1-temper 6000-series aluminum alloy hollow extruded material by electro-magnetic forming. Further, JP-A-2007-254833 and JP-A-2005-105327 disclose a 6000-series aluminum alloy hollow extruded material having excellent pipe expansion formability in electro-magnetic forming.

Meanwhile, in recent years, the durability of coils for electro-magnetic forming has been improved, allowing for the output of higher electro-magnetic force. Therefore, it has been considered to apply the electro-magnetic forming to 7000-series aluminum alloys having higher strength than that of 6000-series aluminum alloys.

Descriptions relating to the pipe expansion of 7000-series aluminum alloy hollow extruded materials are disclosed in JP-A-2010-196089, JP-A-2009-114514, and JP-A-2007-119853, for example. However, the pipe expansion methods in these documents are pipe expansion by pushing a conical die into the pipe or pipe expansion by hydroforming.

Any of the 7000-series aluminum alloy hollow extruded materials described in these documents contains considerable amounts of one or more of Mn, Cr, and Zr and has a fibrous structure as its crystal structure, therefore regarded as having excellent pipe expansion formability. Because being generally used for a structural member, in order to improve SCC resistance (resistance to stress corrosion cracking), a 7000-series aluminum alloy is subject to addition of transition elements such as Cr, Mn, and Zr that causes its crystal structure to be fibrous.

SUMMARY OF THE INVENTION

Typical methods for forming a hollow material by extrusion include mandrel extrusion and porthole extrusion, and the porthole extrusion is preferable in view of productivity. The above-mentioned technique disclosed in JP-A-2010-196089 is based on precondition where the porthole extrusion is applied.

However, in the case that forming by the porthole extrusion is applied to a 7000-series aluminum alloy hollow extruded material whose crystal structure is mainly a fibrous structure, application of the pipe expansion by electro-magnetic forming at a practical level pipe expansion ratio of 20% or more (refer to JP-A-2007-254833 for the definition of pipe expansion ratio) to the hollow extruded material causes a problem where cracking occurs in the formed article.

Specifically, in the case of so-called pipe expansion (see FIG. 4(b) of JP-A-2007-254833), the high pipe expansion ratio is likely to cause formation of cracks (crevices) along the direction of the extrusion axis. In addition, in the case that a flange is formed at an end portion of an extruded material (see FIG. 4(a) of JP-A-2007-254833), the high pipe expansion ratio is likely to cause that fan-like shaped cracks (crevices) in the radial direction are formed in the flange, or that, even if not cracking, necking (a local decrease in thickness) occurs. For example, in the case of forming a mounting flange in which a volt hole can be formed, since a high pipe expansion ratio of 40% or more is usually necessary, the cracking is likely to occur.

The present invention has been made considering such problems of conventional techniques and it is an object of the present invention to provide a 7000-series aluminum alloy hollow extruded material for electro-magnetic forming that has excellent pipe expansion formability in the application of pipe expansion by electro-magnetic forming based on the precondition where the porthole extrusion is applied.

An aluminum alloy hollow extruded material formed by porthole extrusion is formed with a weld extended in the extrusion longitudinal direction that results from the aluminum being once split in a die and then recombined. During the pipe expansion by the electro-magnetic formation of the 7000-series aluminum alloy hollow extruded material that has been formed by porthole extrusion and has a fibrous structure, the cracking occurs at the weld. In the case that a 7000-series aluminum alloy hollow extruded material has a fibrous structure, the weld has a larger structure and a relatively lower strength than a non-weld portion. Therefore, it is presumed that, during pipe expansion by electro-magnetic forming, the weld functions as a stress concentration area and thus cracking occurs in the weld.

Based on the above presumption, according to an embodiment of the present invention, a 7000-series aluminum alloy hollow extruded material formed by porthole extrusion is provided with a recrystallized structure throughout the cross-section, thereby reducing the structural difference between a weld and a non-weld portion. As a result, excellent pipe expansion formability in pipe expansion by electro-magnetic forming has been achieved.

An aluminum alloy hollow extruded material for electro-magnetic forming according to the present invention comprises Zn: 3.0 to 8.0 mass %, Mg: 0.4 to 2.0 mass %, Cu: 0.05 to 2.0 mass %, Ti: 0.005 to 0.2 mass %, Si: 0.3 mass % or less, Fe: 0.35 mass % or less, and one or more of Mn, Cr, and Zr: 0.10 mass % or less in total, with the balance being Al and unavoidable impurities. The aluminum alloy hollow extruded material is formed by porthole extrusion. The aluminum alloy hollow extruded material has a recrystallized structure throughout the cross-section thereof.

The 7000-series aluminum alloy hollow extruded material according to the present invention achieves a practical level pipe expansion ratio of 20% or more without cracking in the electro-magnetic forming and thus exerts excellent pipe expansion formability in the electro-magnetic forming. Therefore, the high-strength 7000-series aluminum alloy hollow extruded material can be used to produce various electro-magnetically formed members, such as a member having a flange formed at an end portion thereof (see JP-A-2007-254833 and JP-A-2005-105327) and a member to be joined by pipe expansion (see JP-A-2010-159005 and JP-A-2010-69927). The present invention is particularly suitable for the formation of a hollow member having a mounting flange at the end portion thereof.

BRIEF DESCRIPTION OF THE DRAWINGS

FIG. 2(*b*) shows a cross-sectional view of the schematic plan view of the electro-magnetic forming test setup in Examples along the line I-I.

DETAILED DESCRIPTION OF THE PREFERRED EMBODIMENTS

Figure 1A:
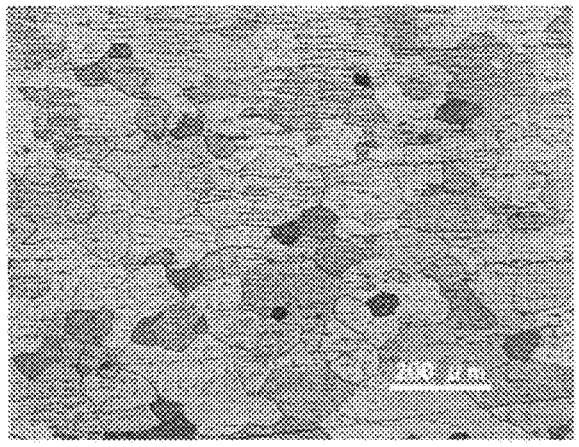
FIGS. 1(*a*) and 1(*b*) respectively show micrographs of the microstructure of Example A1 and that of Comparative Example B7.

Next, the alloy composition, the crystal structure and the like of a 7000-series aluminum alloy hollow extruded material according to an embodiment of the present invention will be described in more detail.

[Alloy Composition]

Zn: 3.0 to 8.0 mass %

Zn is an element that forms $MgZn_2$ as an intermetallic compound with Mg to improve the strength of the 7000-series aluminum alloy. When the content of Zn is less than 3.0 mass %, sufficient strength is not obtained. When the content is more than 8.0 mass %, the resulting strength is so high that a practical level of pipe expansion ratio can not be obtained by the electro-magnetic force of the existing coil for electro-magnetic forming. The content of Zn is preferably 4.0 to 7.0 mass %, and more preferably 4.5 to 6.5 mass %.

Mg: 0.4 to 2.0 mass %

Mg is an element that forms $MgZn_2$ as an intermetallic compound with Zn to improve the strength of the 7000-series aluminum alloy. When the content of Mg is less than 0.4 mass %, sufficient strength is not obtained. When the content is more than 2.0 mass %, the resulting strength is so high that a practical level of pipe expansion ratio can not be obtained by the electro-magnetic force of the existing coil for electro-magnetic forming. The amount of Mg added is preferably 0.4 to 1.7 mass %, and more preferably 0.4 to 1.5 mass %.

Cu: 0.05 to 2.0 mass %

Cu is an element that improves the strength of the 7000-series aluminum alloy. When the content of Cu is less than 0.05 mass %, sufficient strength is not obtained. When the content is more than 2.0 mass %, the resulting strength is so high that a practical level of pipe expansion ratio can not be obtained with the electro-magnetic force of the existing coil for electromagnetic forming. The Cu content is preferably 0.08 to 1.7 mass %, and more preferably 0.1 to 1.5 mass %.

Ti: 0.005 to 0.2 mass %

Ti functions to reduce the size of crystal grains during casting and is added to improve pipe expansion formability in electro-magnetic forming. The amount added is preferably 0.005% or more. Meanwhile, when the amount is more than 0.2%, the above effect is saturated and coarse intermetallic compounds is crystallized to impede pipe expansion formability in electro-magnetic forming. Therefore, the amount of Ti added is 0.005 to 0.2%, preferably 0.01 to 0.1%, and still more preferably 0.01 to 0.05%.

Si: 0.3 mass % or less

Fe: 0.35 mass % or less

Si and Fe are unavoidable impurities contained in an aluminum ingot. When they are present in large amounts in an alloy, coarse intermetallic compounds is crystallized during casting, resulting in a decrease in the ductility of the extruded material. Therefore, the content of Si content is limited to 0.3 mass % or less (including 0 mass %), and the content of Fe is limited to 0.35 mass % or less (including 0 mass %). Preferably, the content of Si is limited to 0.2 mass % or less (including 0 mass %), and the content of Fe is limited to 0.25 mass % or less (including 0 mass %).

Mn+Cr+Zr: 0.10 mass % or less

Mn, Cr, and Zr function to make the crystal structure of the 7000-series aluminum alloy extruded material fibrous to improve SCC resistance (resistance to stress corrosion cracking). Therefore, they are generally added in the case where the extruded material is to be used as a structural member. However, as mentioned above, in the case where the extruded material has a fibrous structure, since cracking is likely to occur during pipe expansion by electro-magnetic forming, a pipe expansion ratio of 20% or more, which is a practical level, can't be achieved without cracking. In the present invention, in order for the extruded material to have a recrystallized structure throughout the cross-section, the total amount of one or more of Mn, Cr, and Zr is limited to 0.10 mass % or less (including 0 mass %), preferably 0.08 mass % or less, and still more preferably 0.05 mass % or less.

[Structure of Extruded Material]

In the case where the crystal structure of the 7000-series aluminum alloy hollow extruded material formed by porthole extrusion is a fibrous structure, there are large differences in structure and strength between a weld and a non-weld portion. Therefore, as described above, when pipe expansion by electro-magnetic forming is applied to the hollow extruded material, because the weld serves as the place of stress concentration, cracking occurs at the weld.

In contrast, in the case where the hollow extruded material has a recrystallized structure throughout the cross-section, cracking is unlikely to occur even when pipe expansion by electro-magnetic forming is performed at a high pipe expansion ratio, resulting in excellent pipe expansion formability. This is presumably because in the case where the hollow extruded material has a recrystallized structure, the differences in structure and strength between the weld and the non-weld portion are smaller than in the case of a hollow extrusion having a fibrous structure, and, therefore, during pipe expansion by electro-magnetic forming, the weld is unlikely to serve as the place of stress concentration.

Therefore, according to the present invention, the hollow extruded material has a recrystallized structure throughout the cross-section. In the present invention, a case where crystal grains have an average aspect ratio of 5.0 or less in the center of the thickness, where recrystallization is least likely to occur (fibrous structure is most likely to remain), is defined as the case where the hollow extruded material has a recrystallized structure throughout the cross-section. It should be noted that the aspect ratio of 5.0 or less indicates that the crystal grains are recrystallized grains in the form of equiaxed grains or in a form close to equiaxed grains.

[Strength of Extruded Material]

The electro-magnetic force of an electro-magnetic forming coil is practically limited. Accordingly, when the strength of the extruded material is too high, a high pipe expansion ratio is not obtained during pipe expansion by electro-magnetic forming. However, in case that yield strength during electro-magnetic forming is 300 N/mm$^2$ or less as shown in Examples below, a pipe expansion ratio of 20% or more, which is a practical level, can be obtained. Generally, electro-magnetic forming is performed before an aging treatment. Therefore, in the 7000-series aluminum alloy hollow extruded material according to the present invention, the upper limit of the content of Zn, Mg, and Cu, which are reinforcing elements, is specified so that the yield strength of temper T1 (a stage where natural aging has not particularly proceeded) after extrusion will be 300 N/mm$^2$ or less. However, the temper of the extruded material during electro-magnetic forming is not limited to T1 (the stage where natural aging has not particularly proceeded), and it may also be an artificially aged material or an O-temper material. In any case, if the yield strength during electro-magnetic forming is more than 300 N/mm$^2$, sufficient pipe expansion ratio can't be obtained because the electro-magnetic force generated by an electro-magnetic forming machine is limited. Here, artificial aging treatments include underaging, peak aging, and overaging. Peak aging is preferable for obtaining high strength. However, in case of the underaging, although strength is slightly lower than in the case of peak aging, local elongation increases. Therefore, the crush resistance of a bumper stay, for example, can be improved. Further, also in the case of overaging, although strength is lower than in the case of peak aging, there is an advantage in that SCC resistance is improved.

The extruded material after electro-magnetic forming is generally subjected to an artificial aging treatment or naturally aged for a predetermined period of time in temper T1 to improve strength, and then is put to practical use. In view of practicability as a structural member, it is preferable that yield strength at that time is 190 N/mm$^2$ or more. Meanwhile, when the amounts of Zn and Mg, which are main components of the alloy, are increased to increase the strength too much, particularly because the extruded material has a recrystallized structure, decreasing in SCC resistance (resistance to stress corrosion cracking) is concerned. However, when yield strength after an aging treatment is 400 N/mm$^2$ or less, SCC resistance has no practical problem under a usual condition of use. The yield strength of 190 to 400 N/mm$^2$ is naturally obtained after the 7000-series aluminum alloy hollow extruded material according to the invention is subjected to an artificial aging treatment or naturally aged for a predetermined period of time. Yield strength after an artificial aging treatment or natural aging for a predetermined period of time is preferably 220 to 390 N/mm$^2$, and still more preferably 230 to 370 N/mm$^2$.

[Pipe Expansion Ratio]

In the present invention, the definition of pipe expansion ratio is the same as in JP-A-2007-254833. That is, pipe expansion ratio δ is defined by the equation (1) listed below, wherein the outer perimeter of a hollow extruded material before pipe expansion by electro-magnetic forming (or an unexpanded portion) is expressed as $L_0$, and the outer perimeter thereof after pipe expansion is expressed as L. Specifically, in the case where a flange is formed at the end portion of a hollow extruded material (see FIG. 4(a) of JP-A-2007-254833) that can is regarded as a kind of pipe expansion, the outer perimeter before pipe expansion (or an unexpanded portion) is expressed as $L_0$, and the outer perimeter of the formed flange is expressed as L. Further, in the case of so-called pipe expansion (see FIG. 4(b) of JP-A-2007-254833), the outer perimeter before pipe expansion (or an unexpanded portion) is expressed as $L_0$, and the outer perimeter of the expanded portion (the largest diameter) is expressed as L.

$$\delta=\{(L-L_0)/L_0\}\times 100(\%) \quad (1)$$

It should be noted that, the extruded material according to the present invention is not limited to one having a circular cross-section but includes those having deformed cross-sections, such as elliptical or polygonal cross-sections. The present invention also includes pipe expansion where the extruded material having circular cross-section is expanded so as to have such deformed cross-section as an elliptical or polygonal cross-section, and vice versa.

Electro-magnetic forming using the aluminum alloy hollow extruded material according to the present invention is performed at a pipe expansion ratio of 20 to 120%. In the case where the pipe expansion ratio is as low as less than 20%, pipe expansion by electro-magnetic forming is possible even without using the aluminum alloy hollow extruded material according to the present invention. Therefore, it is preferable that the pipe expansion ratio is 20% or more. Further, in the case where the pipe expansion ratio is more than 120%, cracking or necking occurs even when the aluminum alloy hollow extruded material according to the present invention having excellent formability is used. Therefore, it is preferable that the pipe expansion ratio is 120% or less. The pipe expansion ratio is more preferably 30 to 100%, and still more preferably 40 to 90%.

EXAMPLES

Each 7000-series aluminum alloy of the composition shown in Table 1 was DC cast into an extrusion billet of 155 mm in diameter, followed by a homogenization treatment at 470° C.×6 h. The extrusion billet after the homogenization treatment was heated to 470° C., extruded from a porthole die into a pipe shape of ϕ 90 mm (outer diameter)×3 mm of thickness, and immediately quenched by fan air cooling.

The obtained extruded materials were subjected to crystal structure observation, an electro-magnetic forming test, and a tensile test in the manner described below. The results thereof are shown in Tables 1 and 2.

TABLE 1

| Alloy No. | | Chemical Component (mass %) | | | | | | | | | | |
|---|---|---|---|---|---|---|---|---|---|---|---|---|
| | | Si | Fe | Cu | Mg | Mn | Cr | Zn | Zr | Ti | Al | Structure |
| Examples of the Present Invention | A1 | 0.03 | 0.17 | 0.16 | 0.64 | — | — | 5.50 | — | 0.03 | Balance | Recrystallized structure |
| | A2 | 0.04 | 0.17 | 0.17 | 1.21 | 0.01 | — | 5.51 | — | 0.02 | Balance | Recrystallized structure |
| | A3 | 0.03 | 0.18 | 0.17 | 1.85 | 0.04 | — | 5.52 | — | 0.03 | Balance | Recrystallized structure |
| | A4 | 0.04 | 0.19 | 0.16 | 0.62 | — | 0.02 | 3.60 | — | 0.02 | Balance | Recrystallized structure |

TABLE 1-continued

| Alloy No. | | Chemical Component (mass %) | | | | | | | | | | Structure |
|---|---|---|---|---|---|---|---|---|---|---|---|---|
| | | Si | Fe | Cu | Mg | Mn | Cr | Zn | Zr | Ti | Al | |
| | A5 | 0.03 | 0.16 | 0.15 | 0.67 | — | 0.05 | 6.51 | — | 0.03 | Balance | Recrystallized structure |
| | A6 | 0.04 | 0.19 | 0.16 | 0.65 | — | — | 7.92 | 0.01 | 0.03 | Balance | Recrystallized structure |
| | A7 | 0.03 | 0.17 | 0.08 | 0.63 | — | — | 5.45 | 0.04 | 0.02 | Balance | Recrystallized structure |
| | A8 | 0.04 | 0.17 | 1.53 | 0.66 | 0.02 | — | 5.51 | 0.02 | 0.04 | Balance | Recrystallized structure |
| | A9 | 0.04 | 0.18 | 1.96 | 0.64 | — | 0.01 | 5.47 | 0.01 | 0.03 | Balance | Recrystallized structure |
| | A10 | 0.03 | 0.18 | 0.18 | 0.65 | — | — | 6.51 | — | 0.02 | Balance | Recrystallized structure |
| | A11 | 0.03 | 0.19 | 0.17 | 1.17 | — | — | 5.54 | — | 0.03 | Balance | Recrystallized structure |
| | A12 | 0.04 | 0.17 | 1.48 | 0.65 | — | — | 5.49 | — | 0.02 | Balance | Recrystallized structure |
| | A13 | 0.03 | 0.17 | 0.16 | 0.45 | — | — | 5.50 | — | 0.03 | Balance | Recrystallized structure |
| | A14 | 0.04 | 0.19 | 0.17 | 0.65 | — | — | 6.49 | — | 0.02 | Balance | Recrystallized structure |
| | A15 | 0.05 | 0.18 | 0.17 | 1.20 | — | — | 5.55 | — | 0.02 | Balance | Recrystallized structure |
| | A16 | 0.04 | 0.18 | 1.50 | 0.65 | — | — | 5.47 | — | 0.03 | Balance | Recrystallized structure |
| | A17 | 0.04 | 0.17 | 0.17 | 0.64 | 0.09 | — | 5.53 | — | 0.02 | Balance | Recrystallized structure |
| | A18 | 0.03 | 0.18 | 0.15 | 0.65 | — | 0.10 | 5.54 | — | 0.02 | Balance | Recrystallized structure |
| | A19 | 0.04 | 0.17 | 0.17 | 0.64 | — | — | 5.54 | 0.09 | 0.02 | Balance | Recrystallized structure |
| | A20 | 0.04 | 0.17 | 0.17 | 0.66 | — | — | 5.52 | — | 0.18 | Balance | Recrystallized structure |
| | A21 | 0.28 | 0.17 | 0.16 | 0.64 | — | — | 5.47 | — | 0.03 | Balance | Recrystallized structure |
| | A22 | 0.03 | 0.32 | 0.16 | 0.67 | — | — | 5.61 | — | 0.03 | Balance | Recrystallized structure |
| Comparative Examples | B1 | 0.03 | 0.16 | 0.17 | 2.84* | — | — | 7.51 | — | 0.03 | Balance | Recrystallized structure |
| | B2 | 0.04 | 0.17 | 0.15 | 0.66 | — | — | 2.51* | — | 0.02 | Balance | Recrystallized structure |
| | B3 | 0.04 | 0.17 | 0.16 | 1.83 | — | — | 9.12* | — | 0.03 | Balance | Recrystallized structure |
| | B4 | 0.03 | 0.19 | 2.91* | 0.67 | — | — | 5.52 | — | 0.03 | Balance | Recrystallized structure |
| | B5 | 0.03 | 0.18 | 0.17 | 0.65 | 0.18* | — | 5.56 | — | 0.04 | Balance | Fibrous structure |
| | B6 | 0.04 | 0.17 | 0.17 | 0.65 | — | 0.19* | 5.54 | — | 0.03 | Balance | Fibrous structure |
| | B7 | 0.03 | 0.16 | 0.16 | 0.65 | — | — | 5.55 | 0.17* | 0.03 | Balance | Fibrous structure |
| | B8 | 0.03 | 0.19 | 0.16 | 0.66 | 0.09* | — | 5.56 | 0.10* | 0.04 | Balance | Fibrous structure |
| | B9 | 0.04 | 0.19 | 0.18 | 0.68 | — | 0.11* | 5.56 | 0.12* | 0.04 | Balance | Fibrous structure |
| | B10 | 0.04 | 0.18 | 0.18 | 0.67 | 0.12* | 0.09* | 5.50 | — | 0.03 | Balance | Fibrous structure |
| | B11 | 0.03 | 0.16 | 0.16 | 2.41* | — | — | 8.50* | 0.18* | 0.03 | Balance | Fibrous structure |

*Contents outside the range specified in the present invention

[Crystal Structure Observation]

A cross-section of a non-weld portion of an extruded material (a cross-section parallel to the extrusion direction and perpendicular to the thickness direction) was etched with a Keller solution. A microstructure photograph of the cross-section was taken and then, by using the structure photograph, the average crystal grain size in the center of the thickness was measured in the extrusion and thickness directions in accordance with the section method of JIS H 0501. The area of the average crystal grain size measurement was, with the line ½t (the center of the thickness) as the center, 500 μm inward and outward in the thickness direction (1000 μm in total)×500 μm in the extrusion direction. The ratio between the average crystal grain size (a) in the extrusion direction and the average crystal grain size (b) in the thickness direction was calculated, and the value a/b or b/a, whichever is greater, was defined as the average aspect ratio of crystal grains in the center of the thickness. It should be noted that, since in B5 and B7 to B11, a fibrous crystal structure was finely formed in the extrusion direction, the average crystal grain size was unmeasurable. However, the average aspect ratio was likely to be obviously more than 10.

With respect to the extruded materials in which the average aspect ratio of crystal grains in the center of the thickness was 5.0 or less (A1 to A22 and B1 to B4), it was judged that such an extruded material had a recrystallized structure throughout the cross-section. Meanwhile, with respect to the extruded materials in which the average aspect ratio of crystal grains in the center of the thickness was likely to be obviously more than 10 (B5 and B7 to B11) and the extruded material in which the average aspect ratio of crystal grains in the center of the thickness was more than 5.0 (B6), it was judged that the cross-section of such an extruded material contained a fibrous structure.

Figure 1B:
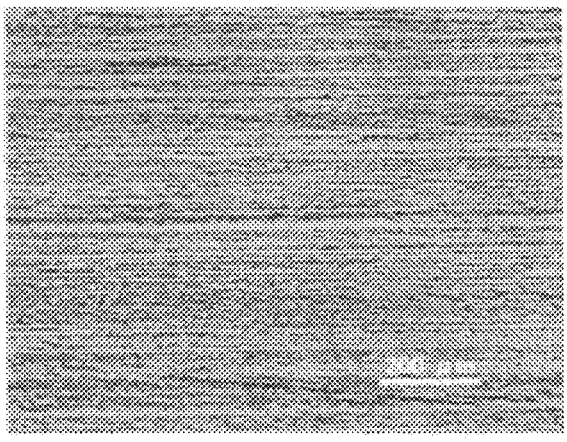

Meanwhile, in addition to the measurement of average crystal grain size, the crystal structure was observed throughout the cross-section (from the line ½t to the surface). As a result, in each of A1 to A22 and B1 to B4 where the average aspect ratio of crystal grains in the center of the thickness was 5.0 or less, the extruded material obviously had a recrystallized structure throughout the cross-section (from the surface to the center of the cross-section). Meanwhile, in each of B5 to B11 where the content of Mn, Cr, and Zr was relatively high, it was identified that the extruded material had a fibrous structure nearly throughout the cross-section. FIGS. 1(*a*) and 1(*b*) show parts of the microstructure photographs of A1 and B7.

[Electro-magnetic Forming Test]

Figure 2A:
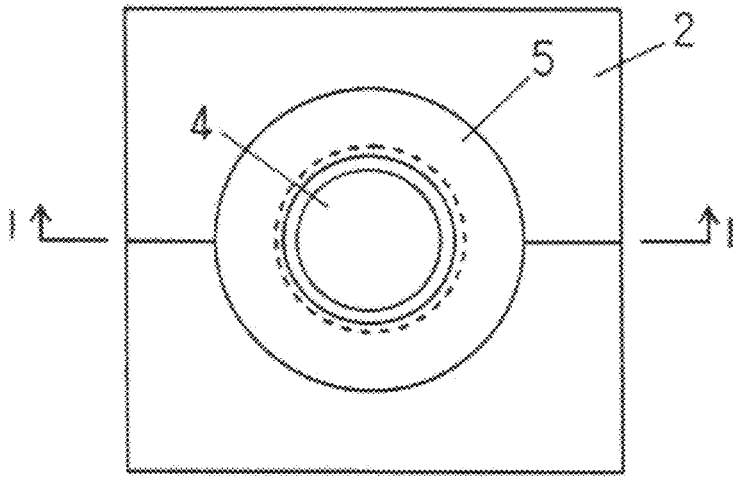
FIG. 2(*a*) shows a schematic plan view of the electro-magnetic forming test setup in Examples.
Figure 2B:
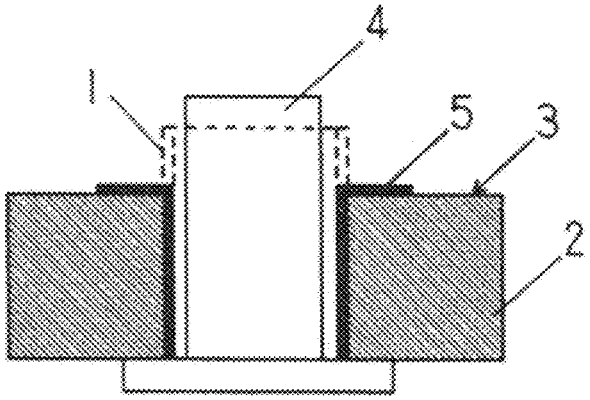

An extruded material (T1 material) that had been left in room temperature (25° C.) for 26 hours after extrusion and thereby naturally aged was cut to a length of 110 mm to give a test specimen and subjected to a pipe expansion test at room temperature using an electro-magnetic forming testing machine. In the electro-magnetic forming test, as shown in FIGS. 2(*a*) and 2(*b*), a die for electro-magnetic forming 2 (made of two separate dies) was used to constrict around a pipe-shaped extruded material 1. In addition, an end portion of the extruded material 1 was set to project from an end surface 3 (shaping surface) of the die 2, and the maximum practical level of electrical energy was applied to a coil for electro-magnetic forming 4 installed inside the extruded material 1. For test specimens A1 to A16 and B1 to B11, the projection length of the end portion of the extruded material 1 was set at 35 mm, while for test specimens A17 to A22, the projection length of the end portion of the extruded material 1 was set at 55 mm. The level of the applied electrical energy was set constant for all the test specimens.

Figure 3A:
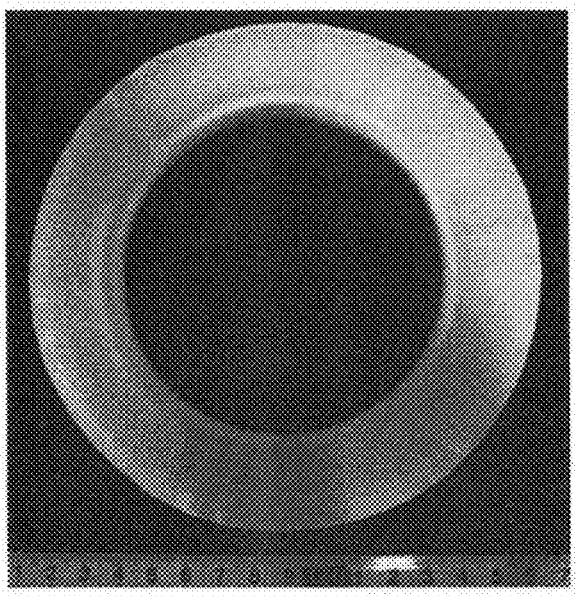
FIGS. 3(*a*) and 3(*b*) respectively show the appearance (photographs) of the flange portion of Example A1 and that of Comparative Example B7 after an electro-magnetic forming test.
Figure 3B:
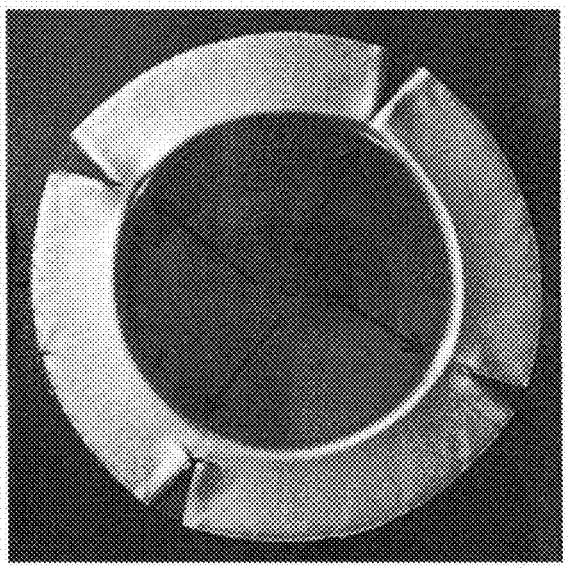

As a result of electro-magnetic forming, the peripheral wall of the end portion of the test specimen 1 projected from the end surface 3 of the die 2 is expanded outward in the radial direction (radiation direction) and pressed against the end surface 3 of the die 2, whereby a flange portion 5 is formed. However, in the case where only a low pipe expansion ratio is obtained, the end portion does not spread flat as shown in FIGS. 2(*a*) and 2(*b*), but a flared flange portion is formed. Each test specimen was checked for the presence of cracks, and test specimens identified as having no cracks were measured for pipe expansion ratio in accordance with the definition given above. FIGS. 3(*a*) and 3(*b*) show the photographs of the appearance of the flange portions of A1 and B7.

[Tensile Test]

An extruded material (T1 material), which had been left in room temperature (25° C.) for 26 hours after extrusion and thereby naturally aged, was used as a test specimen. A tensile test piece (No. JIS 12B) was prepared from the test specimen and subjected to a tensile test at ordinary temperature at a crosshead speed of 2 mm/min to measure the value of yield strength. In addition, after natural aging for 26 hours, A1 to A9, A13, A17 to A22, and B1 to B11 were further subjected to an artificial aging treatment at 90° C.×3 h→140° C.×8 h, A10 to A12 were further subjected to an artificial aging treatment at 90° C.×3 h→130° C.×6 h, and A14 to A16 were further naturally aged at room temperature (25° C.) for 30 days. Using the resulting extruded materials as test specimens, a tensile test was performed as described above to measure the value of yield strength.

TABLE 2

| Alloy No. | | T1 Yield Strength [N/mm$^2$] | Pipe Expansion Ratio (%) | Weld Cracking | Average Aspect Ratio in the Center of Thickness | Yield Strength after Aging [N/mm$^2$] | Remarks |
|---|---|---|---|---|---|---|---|
| Examples of the Present Invention | A1 | 116 | 72 | Absent | 1.1 | 260 | — |
| | A2 | 201 | 65 | Absent | 1.2 | 375 | — |
| | A3 | 254 | 61 | Absent | 1.7 | 397 | — |
| | A4 | 92 | 75 | Absent | 1.1 | 220 | — |
| | A5 | 222 | 64 | Absent | 1.9 | 284 | — |
| | A6 | 240 | 58 | Absent | 1.3 | 389 | — |
| | A7 | 101 | 70 | Absent | 1.4 | 216 | — |
| | A8 | 188 | 64 | Absent | 1.4 | 305 | — |
| | A9 | 234 | 61 | Absent | 1.5 | 354 | — |
| | A10 | 216 | 68 | Absent | 1.1 | 288 | — |
| | A11 | 197 | 66 | Absent | 1.2 | 382 | — |
| | A12 | 179 | 68 | Absent | 1.1 | 307 | — |
| | A13 | 102 | 78 | Absent | 1.0 | 195 | — |
| | A14 | 214 | 67 | Absent | 1.0 | 275 | Natural aging |
| | A15 | 194 | 68 | Absent | 1.2 | 267 | Natural aging |
| | A16 | 180 | 68 | Absent | 1.1 | 209 | Natural aging |
| | A17 | 123 | 111 | Absent | 3.5 | 265 | — |
| | A18 | 118 | 118 | Absent | 2.5 | 261 | — |
| | A19 | 125 | 108 | Absent | 4.8 | 268 | — |
| | A20 | 114 | 105 | Absent | 1.1 | 267 | — |
| | A21 | 116 | 104 | Absent | 1.0 | 265 | — |
| | A22 | 117 | 101 | Absent | 1.1 | 269 | — |
| Comparative Examples | B1 | 320 | 18 | Absent | 1.1 | 478 | — |
| | B2 | 85 | 77 | Absent | 1.0 | 167 | Insufficient strength |
| | B3 | 330 | 15 | Absent | 1.2 | 497 | — |
| | B4 | 318 | 11 | Absent | 1.1 | 450 | — |
| | B5 | 119 | — | Present | — | 295 | Pipe expansion ratio was unmeasurable due to weld cracking |
| | B6 | 120 | — | Present | 9.0 | 289 | |
| | B7 | 123 | — | Present | — | 291 | |
| | B8 | 121 | — | Present | — | 296 | |
| | B9 | 124 | — | Present | — | 299 | |
| | B10 | 123 | — | Present | — | 294 | |
| | B11 | 360 | 6 | Absent | — | 542 | — |

As shown in Tables 1 and 2, in A1 to A22 whose alloy composition is within the specified range of the present invention and which have a recrystallized structure as shown in FIG. 1(*a*), cracking did not occur at the weld during electro-magnetic forming, and a high pipe expansion ratio was obtained in each case. A T1 material is at a stage where natural aging has not proceeded, and its yield strength is 300 N/mm$^2$ or less. Meanwhile, after aging, a yield strength within a range of 190 to 400 N/mm$^2$ was obtained in each case.

Meanwhile, in B2 whose Zn content is lower than specified, although a high pipe expansion ratio is obtained, yield strength after artificial aging is low. As a result, the advantage of the use of the 7000-series aluminum alloy, which is a high-strength alloy, is not obtained.

In B1 whose Mg content is higher than specified, B3 whose Zn content is higher than specified, and B4 whose Cu content is higher than specified, the yield strength of a T1 material is more than 300 N/mm$^2$. As a result, because of the electro-magnetic force limit of the electro-magnetic forming machine, the pipe expansion ratio is low.

In B5 to B10 whose Mn, Cr, and Zr content is higher than specified, in each case, the alloy had a fibrous structure as shown in FIG. 1(*b*), and a greatly expanded flange portion as shown in FIG. 3(*b*) was formed. However, weld cracking occurred (indicated by an arrow 6).

In B11 whose Mg, Zn, and Zr content is higher than specified, the alloy had a fibrous structure. However, the pipe expansion ratio was as low as 6% because of the electro-magnetic force limit of the electro-magnetic forming machine, and weld cracking did not occur.

The present invention has been fully described with reference to the accompanying drawings, but a person skilled in the art can make various changes and modifications. Therefore, as long as they do not depart from the spirit and scope of the present invention, such changes and modifications should be construed as being included in the present invention.

What is claimed is:

1. An aluminum alloy hollow extruded material, comprising:

Zn: 3.0 to 8.0 mass %;

Mg: 0.4 to 2.0 mass %;

Cu: 0.05 to 2.0 mass %;

Ti: 0.005 to 0.2 mass %;

Si: 0.3 mass % or less;

Fe: 0.35 mass % or less;

one or more of Mn, Cr, and Zr: 0.10 mass % or less in total; and

Al, wherein the aluminum alloy hollow extruded material is formed by porthole extrusion, and wherein the aluminum alloy hollow extruded material has a recrystallized structure throughout a cross-section thereof.

2. The aluminum alloy hollow extruded material according to claim 1, wherein the aluminum alloy hollow extruded material is electro-magnetically formed at a pipe expansion ratio of 20% to 120%.

3. An electro-magnetically formed member, obtained by electro-magnetically forming the aluminum alloy hollow extruded material according to claim 1 at a pipe expansion ratio of 20% to 120%.

4. The electro-magnetically formed member according to claim 3, having a yield strength of 190 to 400 N/mm$^2$ given by an aging treatment.

5. A method for producing an electro-magnetically formed member, comprising electro-magnetically forming the aluminum alloy hollow extruded material of claim 1 at a pipe expansion ratio of 20% to 120%, followed by an aging treatment.

6. The aluminum alloy hollow extruded material according to claim 1, comprising Mn.

7. The aluminum alloy hollow extruded material according to claim 1, comprising Cr.

8. The aluminum alloy hollow extruded material according to claim 1, comprising Zr.

9. The aluminum alloy hollow extruded material according to claim 1, comprising Mn and Cr.

10. The aluminum alloy hollow extruded material according to claim 1, comprising Mn and Zr.

11. The aluminum alloy hollow extruded material according to claim 1, comprising Cr and Zr.

12. The aluminum alloy hollow extruded material according to claim 1, comprising Mn, Cr and Zr.

13. The aluminum alloy hollow extruded material according to claim 1, further comprising unavoidable impurities.

* * * * *